United States Patent [19]

Fischer et al.

[11] Patent Number: 4,717,026

[45] Date of Patent: Jan. 5, 1988

[54] CONTAINER SCANNING AND ACCOUNTING DEVICE

[75] Inventors: Gregory J. Fischer, Wheat Ridge; Larry Hopkins, Lakewood, both of Colo.

[73] Assignee: Golden Aluminum Company, Lakewood, Colo.

[21] Appl. No.: 847,503

[22] Filed: Apr. 3, 1986

[51] Int. Cl.[4] ..... B07C 5/02; G06M 7/02

[52] U.S. Cl. ..... 209/539; 194/205; 198/451; 198/786; 209/551; 209/583; 209/644; 209/701; 250/224; 356/428; 377/6; 235/475

[58] Field of Search ..... 209/523, 524, 528, 538, 209/539, 551, 583, 587, 644, 701, 911, 922, 932, 934, 930, 939; 194/205, 208, 209, 212, 213; 198/415, 368, 451, 786; 250/223 R, 224, 557, 566, 568; 356/71, 426, 428; 377/6; 235/425, 462, 463; 364/470, 475, 406

[56] References Cited

U.S. PATENT DOCUMENTS

| | | | |
|---|---|---|---|
| 2,597,930 | 5/1952 | Grosvenor | 198/786 |
| 2,651,412 | 9/1953 | Aller . | |
| 2,776,037 | 1/1957 | Baigent | 198/786 X |
| 2,791,330 | 5/1957 | Carlson . | |
| 3,047,146 | 7/1962 | Clark | 209/701 X |
| 3,135,385 | 6/1964 | Cwycyshyn et al. . | |
| 3,355,014 | 11/1967 | Howles | 209/701 X |
| 3,426,881 | 2/1969 | Dwyer | 198/786 X |
| 3,734,286 | 5/1973 | Simjian | 235/475 X |
| 3,792,765 | 2/1974 | Arp | 194/209 |
| 4,248,334 | 2/1981 | Hanley et al. | 194/209 |
| 4,248,389 | 2/1981 | Thompson et al. | 209/583 X |
| 4,285,426 | 8/1981 | Cahill | 194/209 |
| 4,386,708 | 6/1983 | Sieverin | 209/644 X |
| 4,454,028 | 6/1984 | Vetter et al. | 194/212 X |
| 4,549,662 | 10/1985 | Schoenig, Jr. et al. . | |

FOREIGN PATENT DOCUMENTS

| | | | |
|---|---|---|---|
| 0117402 | 9/1984 | European Pat. Off. | 209/576 |
| 2734278 | 2/1979 | Fed. Rep. of Germany | 209/701 |
| 59-128438 | 7/1984 | Japan . | |

*Primary Examiner*—Robert B. Reeves
*Assistant Examiner*—Edward M. Wacyra
*Attorney, Agent, or Firm*—Sheridan, Ross & McIntosh

[57] ABSTRACT

An apparatus is provided to rapidly and automatically scan the UPC, or bar code, from a series of containers and maintain tallies of the brands and types of containers processed. The containers are fed in end-to-end orientation onto the upper end of the trough between an inclined pair of parallel rollers. Both rollers are rotated in the same direction, causing each container to spin as it slides down the length of the rollers. The inclination of the rollers causes the containers to accelerate, increasing the spacing between containers as they reach the lower end of the rollers. A number of scanners are positioned above the lower end of the rollers to read the UPC from each container.

19 Claims, 3 Drawing Figures

CONTAINER SCANNING AND ACCOUNTING DEVICE

BACKGROUND OF THE INVENTION

This invention pertains generally to the field of recycling used beverage containers. In particular, the present invention is a system for rapidly scanning large numbers of containers and maintaining tallys of the numbers, brands, and types of containers scanned. The present invention provides an apparatus to rapidly and automatically pass large numbers of containers through the field of view of a conventional UPC scanner, and rotate each container so that the entire sidewall of each container is scanned.

In recent years several states have enacted mandatory deposit legislation for beverage containers. In these states, grocery stores and other retail outlets are primarily responsible for redeeming used beverage containers returned by consumers. Arrangements must then be made for the appropriate bottlers or distributors to reimburse each retail outlet for deposits on beverage containers that have been paid to consumers. In some situations, the retailer sorts the containers by brand or type and deals directly with the appropriate bottlers or distributors for reimbursement of deposits paid to consumers. However, in many situations, retailers simply accumulate unsorted containers in bags or boxes. The containers are picked up on a regular basis from retailers by a clearing house. The clearing house sorts and/or counts the containers by brand or type, so that the appropriate bottlers or distributors can be invoiced for deposits returned by each retailer to consumers. Traditional manual sorting and counting techniques used by clearing houses for this purpose are relatively slow and costly.

UPC scanners have gained wide acceptance in grocery stores where they are used at checkout counters to read the UPC, or bar code, from items purchased by consumers. Industry standards have been adopted, and a unique UPC is assigned to each product. Like other food packages, each brand and type of beverage container has been assigned a unique UPC. Although this coding system was originally for use in the context of expediting the checkout process in grocery stores, this technology has also been found to be applicable in recycling used beverages containers.

One principle problem associated with using a UPC scanner for this purpose has been attaining a satisfactorily high processing rate. The scanner used in the preferred embodiment has a field of view consisting of a line a few inches in length. Thus, the problem is to provide a means for rapidly feeding containers through the field of view of the scanner, one at a time, and at a controlled rate. The situation is further complicated by the fact that each container must be rotated while in the field of view of the scanner to allow the scanner to view the entire sidewall of the container to locate the UPC. This combined problem of rapidly transporting a series of containers into the view of the scanner while rotating each container, is difficult to solve without introducing needless complexity. With existing systems of this type, each container is individually staged in front of the scanner by a indexing mechanism, and then rotated by a separate mechanism. For example, U.S. Pat. No. 4,248,389 (column 2, lines 48 et seq.) mentions that a turntable can be used to rotate the container before the scanner. Alternatively, a roller positioned under the container can be employed to spin the container (column 4, lines 14 et seq.). However, arrangements of this type require a transport or indexing mechanism to load each container to and from the turntable or roller. This needless complexity increases the cost of the device, and simultaneously reduces the processing rate and reliability of the system.

In contrast, the present invention involves continuous processing of containers without a mechanism to individually index or stage each container in front of the scanners. Continuous processing presents a new problem in maintaining adequate spacing between containers. Adequate spacing is necessary to ensure that each container is separately scanned. Otherwise, the situation arises where the field of view of the scanner may include sections of two adjacent containers, resulting in the UPC from one container being erroneously read for a second container. This not only results in an inaccurate accounting, but also may result in the wrong container being rejected in the event the scanners are unable to read the UPC from a particular container. The use of a declining pair of rollers in the present invention to simultaneously rotate and accelerate a stream of containers overcomes these difficulties, and allows containers to be stacked end to end at the upper end of the rollers. This constitutes a substantial improvement over the prior art in terms of speed, cost, and dependability.

SUMMARY OF THE INVENTION

The present invention provides an apparatus for rapidly scanning the UPC, or bar code, from large numbers of used beverage containers. A pair of parallel rollers are mounted with one end of the rollers elevated above the other end of the rollers. Both rollers are rotated in the same direction by a motor or other drive means. The diameter and spacing between rollers is fixed to form a trough between rollers sufficiently narrow to support containers. A conveyor or other infeed mechanism is used to feed a stream of containers, in an orientation parallel to the rollers, into the trough at the elevated end of the rollers. Rotation of the rollers causes each container to spin as its slides the length of the rollers. The inclination of the rollers causes the containers to accelerate, resulting in increased spacing between successive containers as they move down the rollers. A number of conventional UPC scanners are positioned above the lower end of the rollers to read the UPC from each container. The spacing between containers resulting from acceleration ensures that only one container is within the field of view of the scanners at a given time. Experimental observation indicates that spacing between containers can be increased by driving the rollers at slightly different rotational speeds.

The information read by the scanners is transmitted to a computer to maintain an accounting of the number of each type and brand of containers processed. In this manner, appropriate reimbursements can be made by each bottler, manufacturer, or distributor for deposits refunded by each retailer to consumers for containers.

In addition to the basic device described above, a number of additional refinements may be added. A jet of air or other ejector means may be added at the lower end of the rollers to reject any containers that have not been successfully scanned. Throughput of the device can be increased by adding a number of accumulator lanes to maintain a steady stream of containers fed onto the rollers.

One object of this invention is to provide a fast, economical, and reliable automated system for identifying and tabulating brands and types of used beverage containers in place of the manual sorting techniques heretofore predominately used in those states requiring beverage container deposits. This provides the substantial additional advantage of greatly reducing costs associated with recycling beverage containers. The present invention also requires far less space than manual sorting.

Another principle object of the present invention is to provide an apparatus for continuous processing of containers, without the need for a mechanism to individually index or stage each container in the field of view of the scanners.

BRIEF DESCRIPTION OF THE DRAWINGS

The present invention will be better understood by reference to the accompanying drawings, in which.

DETAILED DESCRIPTION OF THE INVENTION

Figure 1:
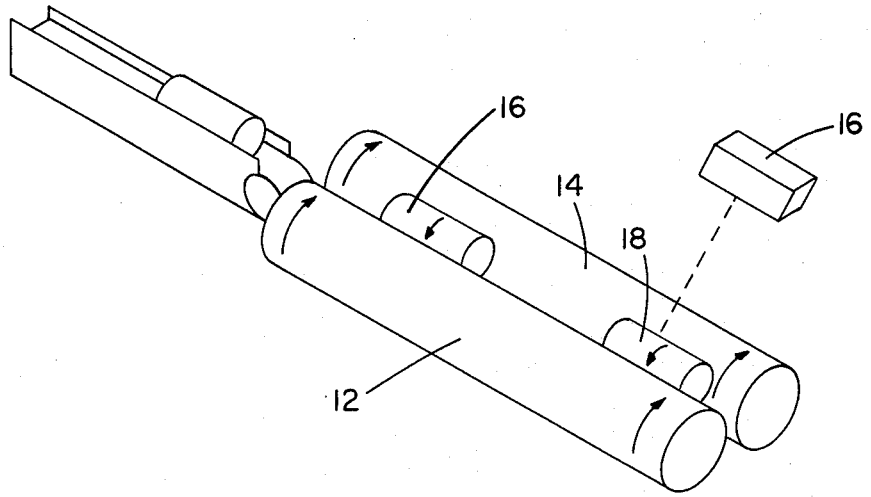
FIG. 1 is a prospective view of the scanning section of the apparatus, showing the pair of rollers and scanners.

Turning to FIG. 1, a perspective view of the basic scanning section of the apparatus is shown. A pair of rollers 12 and 14 are mounted parallel to one another, with one end of the rollers elevated above the other end. The diameter of the rollers and spacing between rollers is fixed so that containers (such as 16 and 18) can be supported in the trough formed between the rollers. Both rollers are driven to rotate in the same direction.

A series of containers are fed into the trough at the upper end of the rollers. Rotation of the rollers imparts spin to the containers. Inclination of the rollers causes the containers to accelerate as they slide along the length of the rollers, continually increasing the spacing between containers as they move toward the lower end of the rollers.

A number of conventional UPC scanners 16 are located above the lower end of the rollers to view each container as it slides and spins along the trough between the rollers. The field of view of a UPC scanner is generally a line a few inches in length. Although each scanner is mounted at a different perspective with respect to the rollers, the field of view of each scanner is fixed to fall within a narrow area near the lower end of the rollers. In order to ensure that the entire sidewall of the container is scanned to find the UPC, each container must complete at least one full rotation within the field of view of the scanners. To accomplish this result, the rotational speed of the rollers and the angle of inclination of the rollers must be determined as a function of the length of the scanners' field of view and the maximum scanner processing rate.

A minimum angle of inclination is necessary to ensure sufficient spacing between containers within the scanners' field of view. If insufficient spacing exists, the scanners' field of view may encompass portions of two successive containers. This may result in the UPC from one container being erroneously applied to another container. In the event the UPC cannot be read from a given container, this condition may result in the wrong container being rejected for subsequent manual processing. In either event, the end result is an inaccurate accounting of the brands and types of containers present in a given batch.

A photo eye 20 detects the presence of a container at a predetermined location along the rollers immediately after the scanners' field of view. This photo eye signals a computer when a container has passed the scanners' field of view. If at least one of the scanners has succeeded in reading a valid UPC from the container, this information is transmitted to the computer to update its tallys and the container is allowed to slide off the lower end of the rollers onto a conveyor or into a bin for subsequent identification, reuse or disposal.

Otherwise, if none of the scanners has read a valid UPC during the time period when the container is within the scanners' field of view, the computer will then activate an ejector means 22 to divert the container into a second chute or bin for subsequent manual processing. In the preferred embodiment, the ejector means is simply an air jet mounted horizontally at the end of the rollers. When activated by the computer, the jet releases a high velocity stream of air that blows the container horizontally into a second conveyor or bin 24. The rejected containers are subsequently processed by hand.

Figure 2:
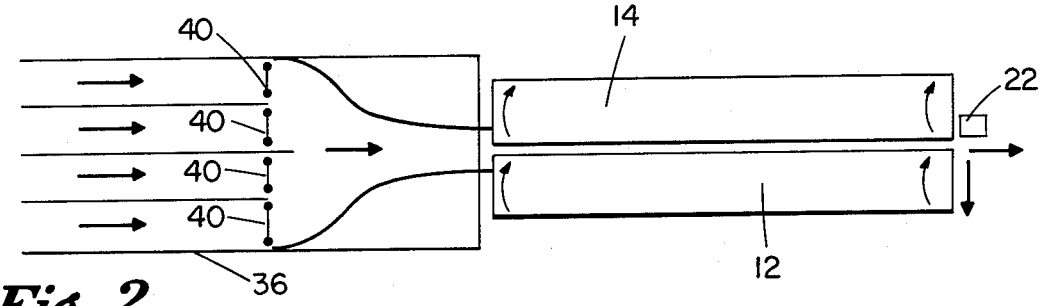
FIG. 2 is a top view of the entire apparatus showing the accumulator lanes and scanning section.
Figure 3:
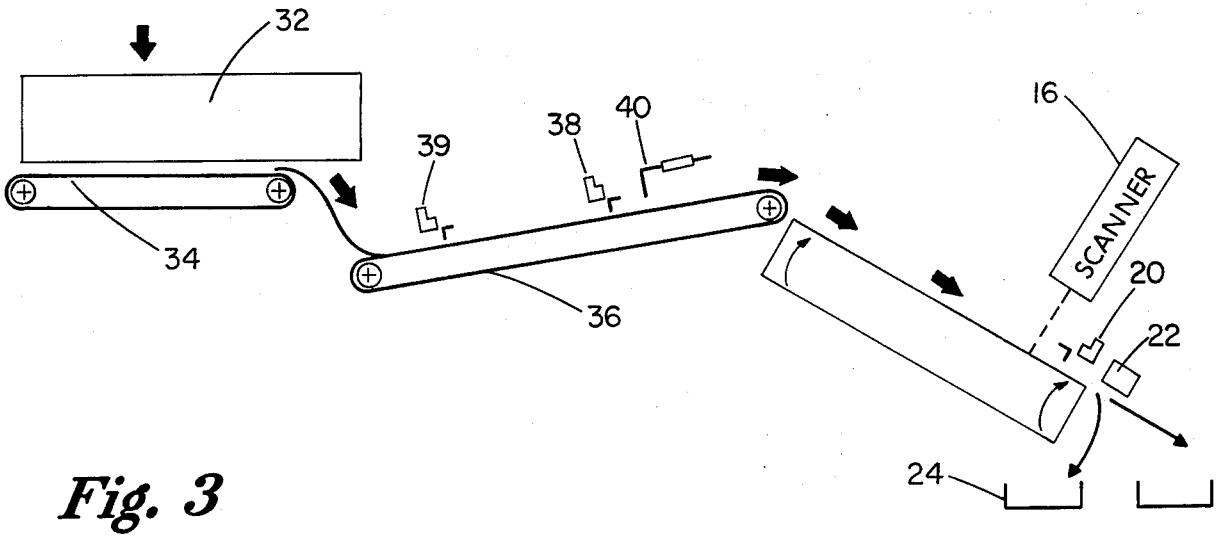
FIG. 3 is a side schematic view of the corresponding to FIG. 2, showing the infeed hopper, accumulator lanes, and scanning section.

FIG. 3 shows a side view of an entire apparatus incorporating the present invention, including an in-feed hopper and accumulator lanes used to rapidly feed large numbers of containers into the scanning section discussed above. The scanning section can be used alone, or with any number of devices to feed a stream of containers in uniform orientation into the scanning section. Similarly, FIG. 2 shows a top view showing the accumulation lanes and scanning section of the present invention.

As previously noted, one principal advantage of the present invention is that no indexing or staging mechanism is necessary to control the timing or spacing between containers released for scanning. In contrast, a continuous end-to-end stream of containers are fed into the scanner section in the present invention. The in-feed hopper and accumulator lanes serve simply to provide a continuous supply of containers to the scanning section. Containers are dumped into the in-feed hopper 32 and fall onto a conveyor belt 34 where the containers are directed into uniform end-to-end orientation by means of a series of guides and baffles. The containers are then transferred to a second conveyor 36 having a number of parallel lanes and gates for accumulating containers. Each lane has two photo eyes 38 and 39 to detect the presence of a container at the entrance of the lane, and behind the control gate 40 at the end of the lane. The gates are activated at the control of a computer that also processes the information generated by the scanning section. In this manner, the computer can regulate the timing and sequence with which containers are released by each lane for scanning. The computer normally activates the gate for each lane in sequence allowing all of the containers accumulated in the lane to proceed to the scanning section. However, in the event the photo eye 38 at the end of a lane indicates that no containers are waiting, the computer may be programmed to skip that lane in the sequence. The photo eyes 39 at the entrance to each lane are used to sense when a lane is full and should be given priority over other lanes. When one or more of the lanes are full, the infeed conveyor belt is temporarily shut down to allow the accumulator lanes to empty.

We claim:

1. A container scanning device comprising:

(a) first and second parallel rollers, each of said rollers having one end elevated above the other end of the rollers, and with the roller diameters and spacing between rollers fixed to form a trough between the rollers sufficiently narrow to support containers between the rollers;

(b) feeder means for singly feeding a stream of containers in an end-to-end orientation into the trough between the rollers at the elevated ends of the rollers, wherein each of said containers contacts both of said rollers along at least a predetermined portion of the length of said trough;

(c) drive means to rotate both rollers in the same direction, said drive means rotating said first roller at a first rotational speed and rotating said second roller at a second rotational speed, wherein each of said containers travels along the length of said trough; and (d) a number of scanners located to view containers along the trough between the rollers, said scanners scanning said predetermined portion of the length of said trough.

2. The container scanning device of claim 1, wherein said first and second rotational speeds are different.

3. The container scanning device of claim 1, wherein the feeder means comprises:

(a) an in-feed conveyor for transporting containers;

(b) means for directing containers into a uniform end-to-end orientation on the conveyor; and (c) a number of accumulator lanes on said conveyor, the release of containers from each of which is controlled by a gate.

4. The container scanning device of claim 3, further comprising:

(a) a sensor located in each accumulator lane to detect the accumulation of containers in each lane behind each gate; and (b) a control for monitoring the sensor in each lane, and controlling the operation of the gate for each lane to prevent overflow of any lane.

5. The container scanning device of claim 1, further comprising ejector means at the lower ends of the rollers for rejecting containers that have not been successfully scanned.

6. The container scanning device of claim 5, wherein the ejector means comprise a jet of air that may be activated to reject containers.

7. The container scanning device of claim 5, further comprising a sensor located toward the lower ends of the rollers to sense when a container has passed the field of view of the scanners, and to subsequently activate the ejector means in the event the container has not been successfully scanned.

8. A container scanning device comprising:

(a) first and second rollers mounted parallel to each other, each of said rollers having one end elevated above the other end at an angle of inclination, and with diameters and spacing between the rollers fixed to form a trough between rollers sufficiently narrow to support containers;

(b) drive means to rotate both rollers in the same direction, said drive means rotating said first roller at a first rotational speed and rotating said second roller at a second rotational speed, wherein each of said containers travels along the length of said trough;

(c) feeder means for singly feeding a series of containers in end-to-end orientation into the trough between the rollers at the elevated ends of the rollers; and (d) a number of scanners located to view containers along the trough at the lower ends of the rollers, said scanners scanning a portion of the length of said trough.

9. A container scanning device as claimed in claim 8, wherein the rotational speeds of said first and second rollers and said angle of inclination of said rollers are predetermined and wherein each of said containers completes at least one revolution within said scanned portion of the length of said trough.

10. A container scanning device as claimed in claim 8, wherein each of said containers has a UPC bar code and said scanners scan said code on each of said containers.

11. A container scanning device as claimed in claim 8, further comprising accounting means to determine whether each of said containers is successfully scanned by said scanners as said containers travel along the portion of the length of the trough scanned by said scanners.

12. A container scanning device as claimed in claim 11, wherein said scanners send a first signal to said accounting means when a container is successfully scanned.

13. A container scanning device as claimed in claim 12, wherein said accounting means comprises detecting means for detecting each container after each container exits said scanned portion of said trough and for sending a second signal corresponding with each detected container.

14. A container scanning device as claimed in claim 13, wherein said accounting means further comprises receiver means for receiving said second signal and wherein said accounting means determines whether a first signal was sent during the time period when each detected container traveled along said scanned portion of said trough.

15. A container scanning device as claimed in claim 14, further comprising ejector means for ejecting any container for which a corresponding first signal was not received by said accounting means during said time period when said container traveled along said scanned portion of said trough.

16. A container scanning device as claimed in claim 8, wherein said feeder means feeds said containers into said trough having the longitudinal axis of each container aligned substantially parallel to said rollers.

17. A container scanning device comprising:

(a) an in-feed hopper into which batches of containers are placed, which discharges containers in a uniform end-to-end orientation;

(b) a number of accumulator lanes for holding containers discharged from the in-feed hopper, and for singly releasing said containers in said end-to-end orientation at a controlled rate to be scanned;

(c) first and second rollers mounted parallel to each other, each of said rollers having one end elevated above the other end at an angle of inclination, and with roller diameters and spacing between the rollers fixed to form a trough between the rollers sufficiently narrow to support containers released by the accumulator lanes, and introduced into said trough at the elevated end of the rollers, wherein each of said containers contacts both of said rollers along at least a predetermined portion of the length of said trough;

(d) drive means to rotate both rollers in the same direction, said drive means rotating said first roller at a first rotational speed and rotating said second roller at a second rotational speed; and (e) a number of scanners located to view containers along the trough at the lower ends of the rollers, said scanners scanning said predetermined portion of the length of said trough.

18. A container scanning device as claimed in claim 17, wherein the rotational speeds of said first and second rollers and said angle of inclination of said rollers are established so that each of said containers completes at least one revolution within said predetermined portion of the length of said trough.

19. A container scanning device as claimed in claim 17, wherein said first and second rotational speeds are different.

* * * * *